United States Patent [19]

Stewart

[11] 3,959,535

[45] May 25, 1976

[54] THREE-DIMENSIONAL STITCHERY ORNAMENTS

[76] Inventor: Alice Stewart, 32761 Seven Seas Drive, Laguna Niguel, Calif. 92677

[22] Filed: Apr. 5, 1974

[21] Appl. No.: 458,063

Related U.S. Application Data

[62] Division of Ser. No. 383,973, July 30, 1973, Pat. No. 3,833,977, Division of Ser. No. 209,058, Dec. 17, 1971, Pat. No. 3,781,954.

[52] U.S. Cl. ..... 428/5

[51] Int. Cl.[2] ..... D04D 7/04

[58] Field of Search ..... 28/2, 15, 77; 161/9, 161/10; 428/4, 5

[56] References Cited

UNITED STATES PATENTS 1,442,124 1/1923 Buckley ..... 28/15

3,708,839 1/1973 Prince ..... 28/15

*Primary Examiner*—Louis K. Rimrodt

*Attorney, Agent, or Firm*—Raymond L. Madsen

[57] ABSTRACT

Three-dimensional stitchery creations are formed according to predetermined stitchery methods on apparatus compromising a base member having dimensions of height, width and length according to the three-dimensions of the stitchery creations formed thereon. The base member has a plurality of surfaces over which are distributed a multiplicity of projections about which stitchery materials may be looped and woven on a given surface and from one surface to another according to the predetermined stitchery methods forming the three-dimensional stitchery creation.

3 Claims, 17 Drawing Figures

THREE-DIMENSIONAL STITCHERY ORNAMENTS

This is a division of application Ser. No. 383,973 filed July 30, 1973, now U.S. Pat. No. 3,833,977, granted 9/10/74 and is a division of application Ser. No. 209,058, filed Dec. 17, 1971 now U.S. Pat. No. 3,781,954, granted 1/1/74.

The present invention relates to ornamental objects, apparatus and methods for making the same and more particularly to three-dimensional stitchery articles, loom apparatus and stitchery methods for making three-dimensional stitchery articles.

In the field of ornamental stitchery, it has been the general practice to employ single-sided stitchery looms having a plurality of standing projections on the single side about which stitchery materials were loomed and woven for the purpose of creating a substantially and essentially flat stitchery ornament. Although such devices have served the purpose, they have not proved entirely satisfactory under all conditions of service for the reasons that considerable difficulty has been experienced in giving the stitchery ornament created thereon the three-dimensional appearance required for certain artistic creations such as stitchery flowers, ribbons, bows, and other articles of similar three-dimensional characteristics.

A typical prior art device is that disclosed in U.S. Pat. No. 3,044,670 issued to J. W. Barefoot, wherein a loom is described upon which ornamental objects are created from a web of ribbon-like material. The loom takes the appearance of a plurality of upstanding pegs arranged in a predetermined pattern and adapted to have loops of the web of ribbon-like material formed thereabout with the running length thereof converging toward the central portion of the pattern and a fastening element centrally disposed in the pattern for securing the running length of the loops together to form the ornamental object. The working surface of the loom comprises a flat circular surface having holes located therein to receive the arrangement of upstanding pegs.

Another prior art device is disclosed by A. L. Hansen in U.S. Pat. No. 1,872,281 wherein a ring-shaped loom frame is described having prongs spaced around the edge thereof, the frame being held by the user in one hand, and yarn or other suitable corded or narrow woven material is worked back and forth and around each prong with the other hand, the result being a plurality of loops radiating from the center of the ring and simulating the petals of a conventional flower design, the center of which is worked by needle into a knot.

Still another prior art device is illustrated by U.S. Pat. No. 2,360,416, issued to G. H. Gray, wherein is disclosed a circular loom or other shaped frame provided with projections on one face in the form of pegs, needles, tacks, pins and so forth, and having an opening in the frame across which yarns can be looped from projection to projection.

J. W. Thomas discloses yet another prior art device in U.S. Pat. No. 2,433,307, which is an adjustable hand-weaving frame made up of a plurality of removably connected frame sections, so constructed that the sections may be arranged to form numerous desirable shapes or designs of various sizes, pins or projections about which the yarns or materials are woven are fixed to one side of the loom permitting only two-dimensional ornamental articles to be formed thereon.

U.S. Pat. No. 3,530,558, issued to J. E. Glick, discloses a further prior art device in the form of a weaving template receptacle having provisions for arranging a plurality of pegs in a desired pattern for weaving artistic objects using yarn or similar material to be looped around the pegs. The pegs are removable for the purposes of arranging the desired pattern for weaving and a storage compartment is provided for the unused pegs. The pegs are mounted on one flat surface and therefore permit only the formation of a two-dimensional ornament.

A lacework holder prior art device is described by Koppo Saito in U.S. Pat. No. 2,750,651, which takes the form of a specially constructed pin cushion into which ordinary straight pins are placed as projections about which yarns or threads may be looped in the process of creating lacework. Although the exterior surface of the pin cushion is curved and the pin cushion itself has dimensions of thickness, the holder was not used to create three-dimensional articles.

Anthony J. Ciroli discloses still a further prior art device in U.S. Pat. No. 2,799,956 a yarn design forming tool to provide a woven design having a plurality of loops arranged about an open center according to a predetermined plan. The forming tool has a plurality of anchoring fingers about which the thread or yarns are looped. The number in height or the spacing of the post can be arranged to accomplish different designs. Since all the projections are located on one side, it is impossible to create three-dimensional ornaments thereon.

In U.S. Pat. No. 2,825,169, Anthony J. Ciroli discloses yet a further prior art device in the form of an article made on a loom device described as a jewel-studded open center rosette. Although the rosette is comprised of overlapping loops of weaving or stitchery material, it is substantially flat and is not three-dimensional in characteristic.

Those concerned with the creation of stitchery ornaments have long recognized the need for ornaments having three-dimensional qualities. The present invention fulfills this need.

One of the most critical problems confronting creators of stitchery ornaments has been finding apparatus and methods for creating three-dimensional stitchery ornaments, which is overcome by the present invention.

The general purpose of this invention is to provide three-dimensional stitchery ornaments and apparatus and methods for making the same which embrace all the advantages of similar stitchery articles and apparatus and methods for making the same and possesses none of the aforedescribed disadvantages limiting the ornaments made to substantially two-dimensions. To obtain this, the present invention contemplates a unique stitchery loom arrangement providing a plurality of surfaces and projections thereon whereby three-dimensional ornaments may be created by looping and weaving stitchery material from one surface to another.

An object of the present invention is the provision of a three-dimensional stitchery ornament.

Another object is to provide three-dimensional stitchery flowers, having life-like dimensional realism.

A further object of the invention is the provision of apparatus for forming three-dimensional stitchery ornaments.

Still another object is to provide a loom device for holding and supporting three-dimensional stitchery ornaments formed thereon.

Yet another object of the present invention is the provision of a stitchery loom upon which stitchery materials may be looped and woven into three-dimensional stitchery ornaments and flowers.

A still further object is the provision of methods for making three-dimensional stitchery ornaments.

Yet still a further object is to provide methods for weaving and looping stitchery materials into three-dimensional stitchery ornaments.

Still another further object is to provide stitchery methods for creating and forming three-dimensional stitchery flowers.

Other objects and many of the attendant advantages of this invention will be readily appreciated as the same becomes better understood by reference to the following detailed description when considered in connection with the accompanying drawings in which like reference numerals designate like parts throughout the figures thereof and wherein:

FIGS. 1(a) through FIG. 1(f) illustrate pictorial views of preferred structural embodiments of the invention;

FIGS. 2(a) through FIG. 2(c) show a plan view of a preferred embodiment of the invention;

FIGS. 3(a) through FIG. 3(c) show another plan view of an embodiment of the invention;

Figure 1F:
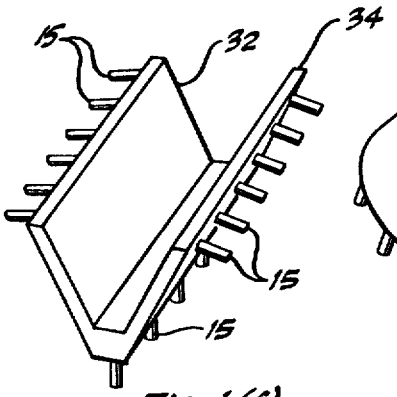
Figure 1A:
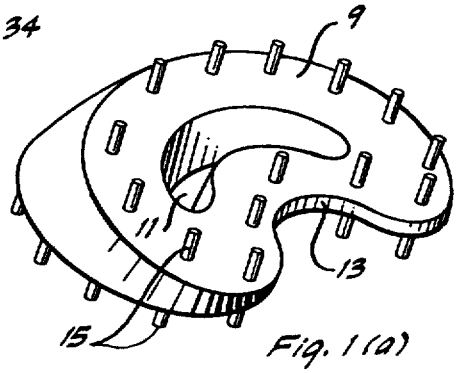

Turning now to FIG. 1(a), a stitchery loom is illustrated having a body member 9 in which there is an opening 11 from one working surface to another and a cutout 13. Pegs 15 are mounted upon the working surfaces for the purposes of holding and looping stitchery material.

Figure 1D:
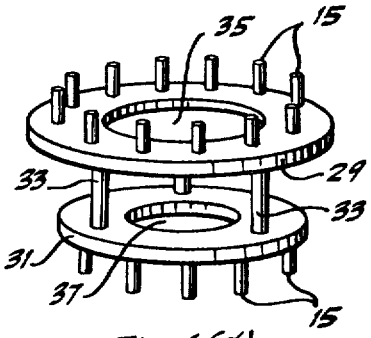
Figure 1B:
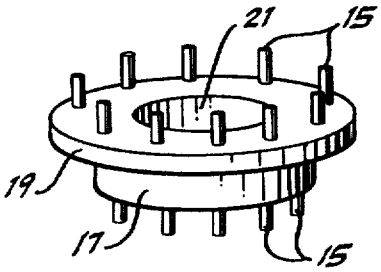

FIG. 1(b) shows a loom structure having an annular shape, comprising two body members 19 and 17 which may be separate or integrally joined, each body member having a working surface thereon upon which pegs 15 are mounted for looping and weaving stitchery material. A circular opening 21 connects the working surface of body member 17 with the working surface of body member 19.

Figure 1C:
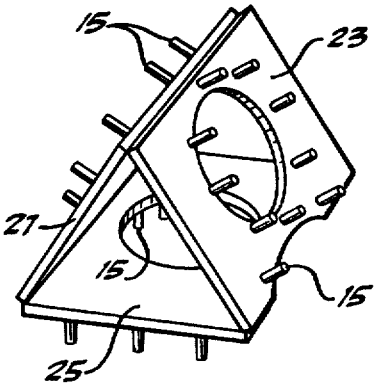

FIG. 1(c) illustrates a stitchery loom having flat body members 23, 25, and 27 joined at their edges in a triangular structure, each body member having appropriate openings and cut-outs therein through which stitchery materials may be looped and woven about pegs 15 mounted on the working surface of each body member.

FIG. 1(d) shows a structure similar to that illustrated in FIG. 1(b) comprising two annular disk body members 29 and 31 interconnected by means of rods 33. Opening 35 in body member 29 and opening 37 in body member 31 permit stitchery material to be directed from pegs 15 mounted on the working surface of body member 29 to pegs 15 mounted on the working surface of body member 31.

Figure 1E:
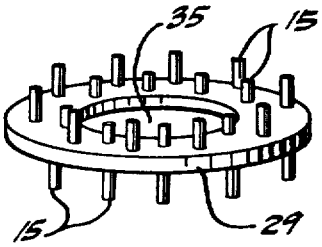

FIG. 1(e) illustrates one extreme of the loom structure contemplated within the scope of this invention, showing annular disk body member 29 with opening 35 centrally located therein and pegs 15 mounted on the opposite surfaces thereof.

FIG. 1(f) illustrates a loom formed by joining two rectangular planar bodies 32 and 34 at one edge into a "V" shaped structure. Pegs 15 are mounted on the surface formed at the juncture of planar bodies 32 and 34 which is the apex of the "V" and on the outer surfaces of planar bodies 32 and 34 adjacent to the edges parallel to the juncture.

Figure 2A:
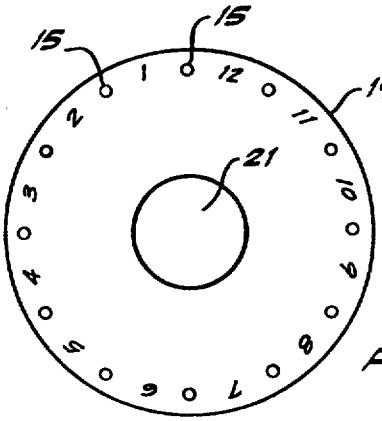
Figure 2B:
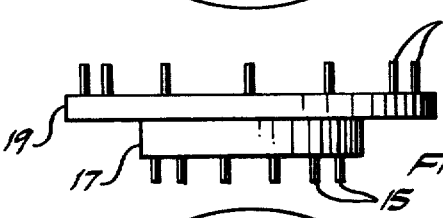
Figure 2C:
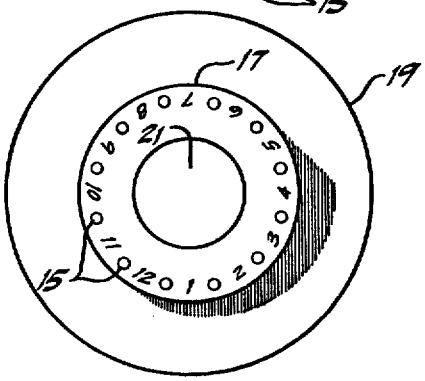

In FIG. 2, a plan view of the structure illustrated in FIG. 1(b) is shown with FIG. 2(a) showing a top view of body member 19 with opening 21 therein and pegs 15 circularly mounted thereon. FIG. 2(b) shows a side view of body members 19 and 17 connected together or integrally joined and shows pegs 15 mounted on the respective working surfaces thereof. FIG. 2(c) shows a bottom view of smaller body member 17, overlapping body member 19 with opening 21 connecting the respective working surfaces and pegs 15 circularly mounted on the working surfaces of body member 17. The spaces between pegs are numbered to aid in describing the methods of making stitchery ornaments.

Figure 3A:
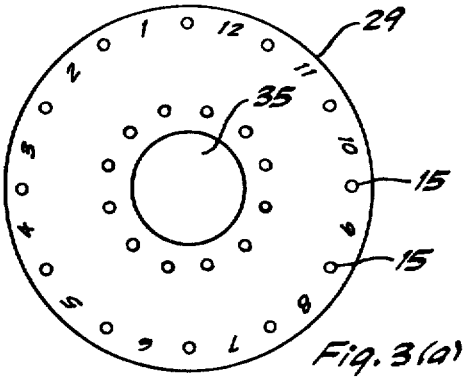
Figure 3B:
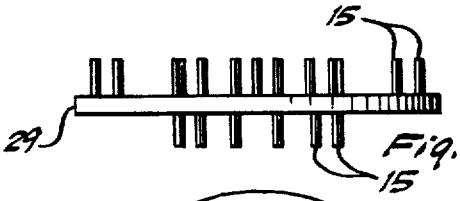
Figure 3C:
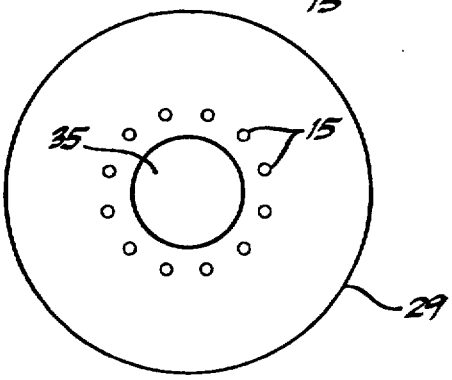

FIG. 3 illustrates a plan view of the loom structure shown pictorially in FIG. 1(e). FIG. 3(a) shows the top view body member 29 with opening 35 centrally located therein and with two concentric rings of pegs 15 located adjacent the edges of the annular body member. There are twelve pegs and twelve spaces therebetween illustrated in each concentric ring. FIG. 3(b) illustrates a side view of body member 29, the pegs mounted on opposite surfaces thereof. FIG. 3(c) shows a bottom view of body member 29 with one concentric ring of twelve pegs 15 mounted adjacent to the edge of opening 35.

Figure 4:
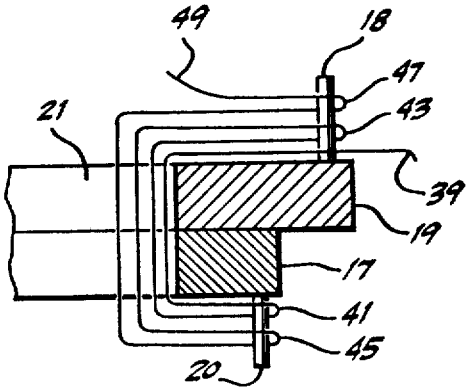
FIG. 4 illustrates a cross-sectional view of the invention shown in FIG. 2(b) with stitchery material looped and woven thereon to illustrate the method of forming double stitchery loops from one working surface to another.

FIG. 4 shows a cross section view of the loom structure of FIGS. 2 and 1(b) wherein stitchery material 39 passes through opening 21 and is looped about Peg 20 attached to body member 17, the loop being designated as loop 41. The stitchery material then passes through opening 21 and is looped about Peg 18 mounted on body member 19 to form loop 43. The material again passes through opening 21 and engages peg 20 with loop 45 and returns again through opening 21 to engage Peg 18 with loop 47, the running end 49 being free to continue on to the next set of adjacent pegs in a similar manner.

Figure 5:
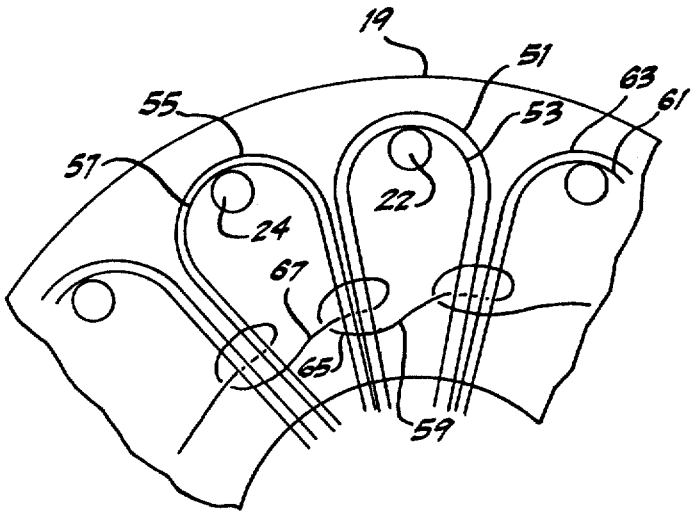
FIG. 5 illustrates a section of the invention shown in FIG. 2(a) having double loops of stitchery material formed thereon with a chain lock stitch going from loop to loop, binding adjacent double loops together.

FIG. 5 shows overlapping loops 51 and 53 formed about peg 22 and overlapping loops 55 and 57 formed about Peg 24 on the working surface of body member 19. Stitchery material 59 passes over contiguous portions of overlapping loops 51, 53 and 55, 57 to form loop 65 after which the stitchery material passes under the contiguous portions of loops 51, 53 and 55, 57 and back through loop 65 to form a lock stitch. The running end portion 67 of the stitchery material is directed on to the next set of adjacent loops and the lock stitch is repeated.

Figure 6:
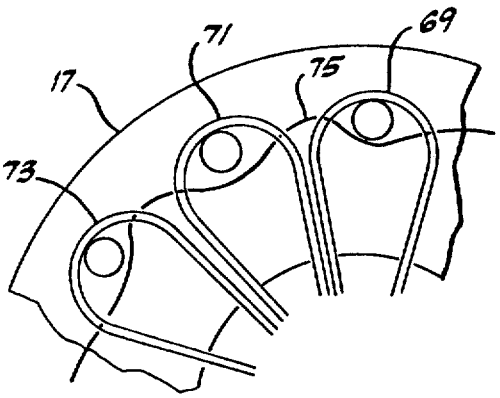
FIG. 6 illustrates a section of the invention shown in FIG. 2(a) having double loops thereon linked by a drawstring of stitchery material.

FIG. 6 illustrates adjacent double loops 69, 71 and 73 with stitchery material 75 passing through and linking each of the double loops.

Figure 7:
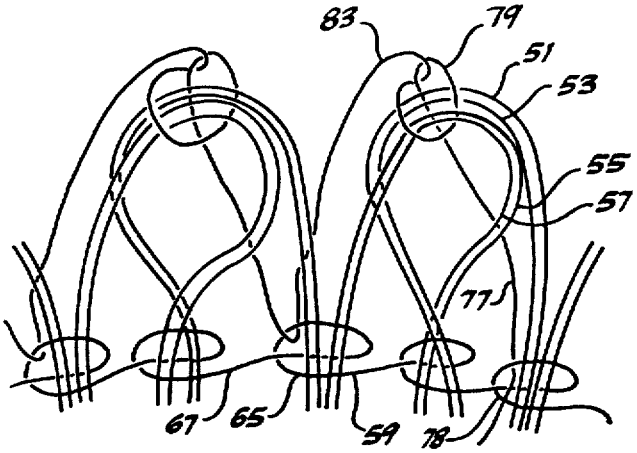
FIG. 7 illustrates the method of overlapping adjacent double loops and fastening them together with a chain lock stitch.

FIG. 7 illustrates the lock stitch of FIG. 5 showing contiguous portions of adjacent double loops in combination with a further lock stitch which joins the outermost portions of overlapping loops 51, 53, and 55, 57. Stitchery material 77 passes through the loop at lock stitch 78 and between overlapping loops 51, 53 and 55, 57 at their outermost end portions and then wrapped around loops 51, 53 and 55, 57 to form a first loop 79. The stitchery material is then passed under loop 79 to form a lock stitch. The stitchery material is then passed through a loop 65 of the next locking stitch joining the contiguous sides of the double loops as illustrated in FIG. 5 and then on to link and attach outermost end portions of the next set of overlapping loops.

Figure 8:
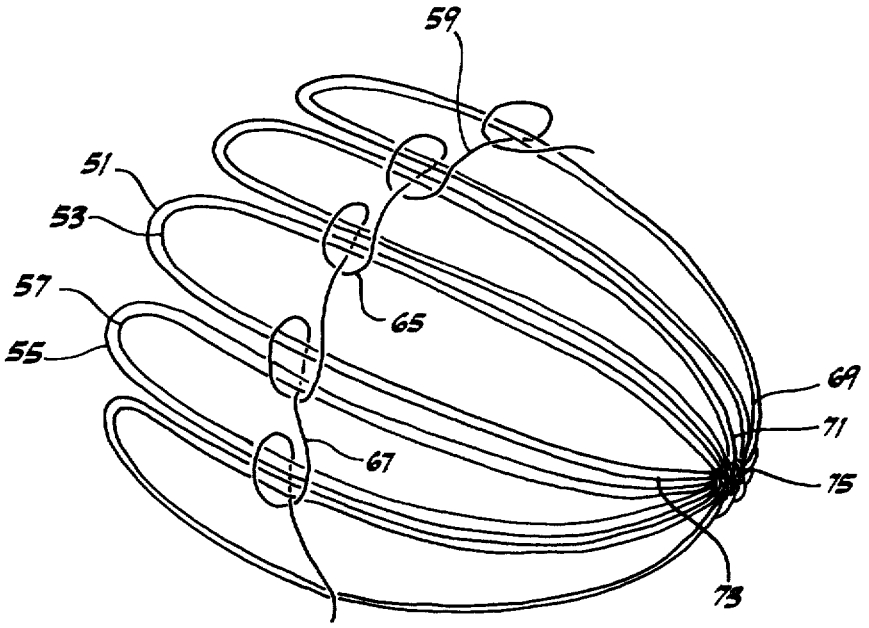
FIG. 8 shows the stitchery ornament of FIGS. 4, 5 and 6 removed from the stitchery loom.

FIG. 8 shows the three-dimensional ornament created by the repeated assembly of the overlapping loops illustrated in FIGS. 4 and 5. Overlapping loops 51 and 53 are joined to overlapping loops 55 and 57 by stitchery material 59 passing over contiguous portions of overlapping loops 51, 53 and 55, 57, to form loop 65 after which the stitchery material passes under the contiguous portions of loops 51, 53 and 55, 57, and back through loop 65 to form a lock stitch. The stitchery ornament thus formed is a substantially cylindrical shape having two open ends, one end of which is closed by stitchery material 75 of FIG. 6 being pulled tightly bringing together all the ends of the loops including adjacent double loops 69, 71 and 73.

The operation of the stitchery loom invention can best be described by reference to FIG. 1. All of the structures illustrated therein are characterized by having a multiplicity of working surfaces on which there are located protrusions for looping and holding stitchery materials. Further, the structures have openings and cut-outs whereby stitchery materials may be directed from one working surface to another. Through predetermined stitchery methods and techniques it is possible to utilize the structures as shown in FIG. 1 to form stitchery ornaments having dimensions of height, width and length. As a result, the stitchery ornaments and articles are three-dimensional, whereas heretofore such stitchery ornaments and articles were limited to substantially a two-dimensional or planar configuration.

Turning to FIG. 1(a), it can be seen that there are two working surfaces on the body member 9 and that protrusions or pegs 15 thereon can hold and support stitchery materials which may be directed through opening 11 and through cut-out 13 from one working surface to the other. Since the working surfaces are separated by the thickness of the body member 9, the stitchery ornament formed thereon will not only have the two dimensions of a working surface but also will have the dimension of thickness created by the stitchery material being woven from one working surface to the other. It should be noted that the working surfaces are not necessarily parallel to one another but may be tilted or angled with respect to one another as illustrated in FIG. 1(a). It should also be noted that many shapes and forms are anticipated for such a loom structure and are not limited to those structures illustrated in FIG. 1. The loom structures may be made from many materials such as metal, wood, plastic, and other such materials of similar nature and characteristics.

Turning now to FIG. 1(b), annular working surfaces on body members 17 and 19 contain protrusions 15 about which stitchery material may be looped and woven. The annular working surfaces are shown parallel but again are not restricted to such a relative position. Opening 21 between the annular working surfaces permits stitchery material to be woven and looped from protrusions on one working surface to protrusions on the other working surface, thereby achieving a third dimension to the stitchery article. It should be clear that body member 17 and body member 19 may be separate and removable one from the other and may have mounting surfaces which may be joined for the purposes of making a multi-working surface loom according to the teachings of this invention or that body members 19 and 17 may be integrally formed into one piece, making a unitized main body structure. A similar method of attaching body members 17 and 19 is by engaging rubber bands between projections on one working surface and projections on the other.

Another variation in structure is illustrated in FIG. 1(c) which permits a stitchery ornament to be formed not only having three dimensions, but also having many facets of ornamental appearance, depending on the direction from which it may be viewed. This is accomplished through the utilization of a multiplicity of working surfaces such as provided by body members 23, 25 and 27. The triangular formation of these inter-connected planar body members basically forms three working surfaces upon which protrusions are mounted to hold the stitchery materials. Stitchery material may be then looped and woven from the working surface of body member 23 through the opening therein and through the opening in body member 25 to the working surface thereon. In addition, the stitchery material may be woven from the working surface of body member 23 through the opening therein and through the opening (not illustrated) in body member 27 to the working surface thereon. Furthermore, cut-outs in the body members may be made at their point of juncture to provide another path between one working surface and another for further three-dimensional effects. Consequently, a very intricate and complicated stitchery ornament can be formed on a structure such as is illustrated in FIG. 1(c).

Other loom structures having joined planar surfaces are anticipated to be within the scope of this invention and range from a circular form, such as a geodesic structure, to rectangular in form such as a box-like structure as illustrated in FIG. 1(c) and the "V" structure of FIG. 1(f) having pegs mounted along the apex in addition to those on the planar surfaces. The plainar body members may be fastened by hinges one to another so that the loom structure may be folded compactly when not in use or to create different loom shapes for special stitchery creations. It should be noted that the pegs may be removed for storage or may be removeably located in holes provided therefor to accommodate new patterns of stitchery designs.

FIG. 1(e) illustrates a loom structure wherein there is substantially no thickness dimension. Although a stitchery ornament held and supported thereon may not have the appearance of three-dimensions, it is possible to locate the protrusions or pegs 15 on each of the two working surfaces to provide loops of stitchery material thereon which cause the ornament to take on a three-dimensional appearance when removed from the substantially flat loom structure.

The loom structure shown in FIG. 1(d) combines two of the loom structures illustrated in FIG. 1(e) by joining them with supporting and separating rods 33. Consequently, stitchery material may be looped from the working surface on base member 29 through opening 35 therein to the opening 37 in base member 31 and therethrough to the working surface on base member 31. Consequently, substantially the same structure is formed as far as working surfaces and protrusions are concerned as is illustrated by the structure of FIG. 1(b).

It should be noted that in all of the structures described in FIG. 1, a stitchery ornament may be formed which is characterized by three-dimensions. The method of weaving and looping stitchery materials between working surfaces of a given loom structure is illustrated in FIG. 4. Stitchery material 39 is placed between two peg-like protrusions or in the space between two protrusions and may be held in place either by holding against the loom structure or in a notch (not illustrated) provided in the structure. The stitchery material then is directed through opening 21 to the working surface of body member 17 and looped about peg 20, forming loop 41, and then returned through opening 21 to the working surface of body member 19. Then the stitchery material is looped around peg 18, forming loop 43 and returned through opening 21 in a manner overlapping the starting end 39 of the stitchery material. The stitchery material is again looped around peg 20, forming loop 45 and returned through opening 21 to peg 18 and is directed there around to form loop 47. The portion of the stitchery material 49 is then directed through opening 21 to the next peg adjacent to peg 20 on body member 17 and the process is repeated by looping the stichery material around the adjacent peg and returning through opening 21 to the next peg adjacent to peg 16. Again, double loops are formed around the adjacent pegs and the method continued until all of the pegs have been looped by double loops in this manner. Although double loops have been illustrated in FIG. 4, it should be noted that any number of loops may be employed as desired to achieve a given stitchery effect. Although the stitchery method described is illustrated on the loom structure of FIG. 1(b) and FIG. 2, it should be noted that any loom structure may be utilized and that the same looping and weaving method is applicable between any two working surfaces thereof.

The stitchery method described in conjunction with FIG. 4 forms a basic stitchery ornament which may be utilized by itself or in conjunction with other stitchery forms hereinafter described to create more complex and intricate stitchery ornaments. The stitchery materials used may be yarn, string, ribbon, plastics, straw, thread, and other similar materials having light, pliable and/or flexible qualities.

A method for fastening and tying the adjacent sides of the double loops formed as shown in FIG. 4 is illustrated in FIG. 5. Loops 51 and 53 are formed about peg 22 and loops 55 and 57 are formed about adjacent peg 24 in the manner described in connection with FIG. 4. In order to maintain the loops in the position described it is necessary to attach them or join them together and thereby creating certain desired stitchery formations and ornaments. Since portions of adjacent loops are contiguous in the region near where they enter the opening 21, as illustrated in FIG. 5, it is convenient to join the loops at some point in this region. Stitchery material 59 is directed over the contiguous portions of loops 51, 53 and adjacent loops 55, 57. As the stitchery material is passed over this region, loop 65 is formed and the stitchery material then passed back over this region in the reverse direction and then returned under this contiguous portion of loops 51, 53 and 55, 57 and passed through loop 65, thereby forming a lock stitch to hold the loops tightly together when the stitch is pulled tight. The stitchery material is then continued on to the next contiguous region of adjacent loops and the lock stitch is repeated. This process is continued until all the loops have been joined in this manner. When the stitchery ornament is removed from the projections or pegs, loops 55 and 57 are held juxtaposition to loops 51 and 53 and are maintained in their loop-like form by the lock stitch.

The stitchery ornament formed by the method described in conjunction with FIG. 5 is another basic creation which may be utilized as an ornament or article by itself or in conjunction with other stitchery ornaments or articles which may be woven in a similar manner. Therefore, when used in conjunction with the double loop method of FIG. 4 a three-dimensional stitchery article is formed heretofore not possible without the loom structure of this invention. Such an article is best described by the method by which it is made.

Although the linking of double loops is discussed in connection with FIG. 5, it should be noted that a multiplication of loops may be employed and are contemplated within the scope of this invention.

In FIG. 6, there are illustrated loops 69, 71 and 73 which are successively adjacent to one another. Stitchery material 75 is then passed through each loop in succession until all loops have been linked thereby. When the loops are removed from the loom structure, stitchery material 75 is then drawn tight, thereby joining all the loops at a common juncture at their ends to form a bud-like stitchery ornamental structure which is useful in many stitchery flower articles. It should be noted that the method of joining the loops discussed in connection with FIG. 6 may be utilized on one working surface of a loom structure and the method of joining the loops set forth in connection with FIG. 5 may be used on another working surface so that various stitchery articles having different shapes and forms may be created.

Turning now to FIG. 7, there is illustrated a stitchery method used, in addition to that described in connection with FIG. 5, whereby adjacent multiple loops are overlapped and joined at the free ends thereof. The adjacent contiguous sides of the multiple or double loops are joined by the lock stitch formed by stitchery material 59 passing over the contiguous portions of the loops to form a loop 65 and then reversing direction for passing underneath the contiguous portion of the loops in this manner, stitchery material 77 is passed through such a lock stitch and is then passed between the overlapping double loops 51, 53 and 55, 57 at their remote end portions. The stitchery material then is returned around overlapping loops 51, 53, and 55, 57 to form loop 79. The portion of the stitchery material 83 is then passed under the loop 79 to form a locking stitch, thereby holding firmly and joining the overlapping loops 51, 53 and 55, 57 at their remote end portions. The stitchery material is then directed through the next successive side lock stitch which joins the sides of the next adjacent loops with the contiguous sides of loops 55, 57 and the process is again repeated to join the next set of overlapping loops.

The method described in connection with FIG. 7 produces a stitchery ornament which has application to the formation of three-dimensional stitchery flowers. The stitchery article formed thereby resembles flower petals. Again, the stitchery method described in connection with FIG. 7 may be utilized with the stitchery methods described in connection with FIGS. 5 and 6 to achieve various stitchery article forms as desired.

To further illustrate the use of the loom structure described in this invention and the methods for utilizing the structures to create stitchery ornaments, the method for making stitchery tulips, lilies, daffodils, narcissus, and bud forms of these flowers will be discussed in connection with FIG. 2. It should be noted that the technique described can be adapted to many loom forms and structures. Although the loom structure of FIG. 2 illustrates different sized base members 19 and 17, it should be realized that equal sized base members or identically matching peg positions may be utilized.

Turning to FIG. 2, with the working face of body member 19 facing up, start the stitchery material from underneath the loom, through the center hole 21 and bring it to the outer edge of any space. For the purposes of this discussion, Space No. 1 will be designated as the beginning space. The stitchery material is then held under the thumb or in an appropriate slot formed in the loom structure for this purpose. Next, take the portion of the stitchery material passing through the opening 21 and direct it into a space between pegs on the working face of body member 17 directly underneath the space 1 utilized on body member 19. For purpose of clarity, this space on body member 17 will also be designated as space 1. The material is then passed around the peg adjacent to space no. 1 and through next adjacent space no. 2 and returned up through opening 21 to the upper working surface of body member 19. The stitchery material is then directed through next adjacent space no. 12 and around the peg between spaces no. 12 and no. 1 and back through space no. 1, returning over the starting end of the stitchery material. The process is repeated forming a second loop over the first loop on the bottom surface and a second loop over the loop formed on the top side. Therefore, a double loop has been formed on the top and bottom working surfaces. Next, the stitchery material is directed from the upper working surface down through opening 21 and into space no. 12 of the lower working surface and around the peg between spaces no. 12 and no. 1 and through space no. 1 back up into opening 21. The stitchery material is then placed in space no. 1 of the upper working surface and around the peg located between spaces no. 1 and no. 2 and then into space no. 2 and back through opening 21. When looking at the working surfaces, the stitchery material is worked clockwise on the lower working surface and counterclockwise on the upper working surface. This up and down looping and threading is continued until all the spaces and pegs have been threaded with two loops.

Next, the adjacent contiguous portions of the loops are fastened together with stitchery material. A curved needle is more adaptable than a straight needle to this technique since it enables the stitchery meterial to be more easily worked under the stitchery loops formed on the loom structure. The adjacent contiguous portions of adjacent loops are sewn together, using a lock stitch. The point of stitching should be approximately halfway between the outer edge of the working surface and the inner edge surrounding opening 21. The stitching is continued around the working surface, sewing the left side of one loop to the right side of the adjacent loop to the left. The chain stitch is drawn tightly. The last stitch is double stitched over the first lock stitch made. This keeps an even shape to the flower.

At the outside edge of the lower working surface, the needle with stitchery material is passed under one edge of a double loop and over the other edge of the same loop and continued on to the edge of the next adjacent loop and under the other edge of the next adjacent loop as shown in FIG. 6 and so on until all of the loops have been linked by the stitchery material. Although the method has been discussed in respect to the lower working surface, it can be applied to the upper working surface as well.

All the loops are removed from the pegs, first one side and then the other, and the stitchery ornament is removed from the loom structure. The stitchery material, linking the loops from the lower working surface is drawn up and secured to form a base of the tulip shape. This drawstring technique is a convenient method of capturing all the loops to form the tulip base. The loops also may be linked up after removal from the loom structure.

Next, a first set of loops is selected which were formed on the upper working surface and a next set of loops to the left is placed on top and overlying the first set of loops. The needle with stitchery material is directed through the inside of the flower shape and through a lock stitch that is located on the right side of the underlying set of loops and directed between the sets of the loops to form a french knot or chain stitch around the overlapping outermost end regions of the two sets of overlapping loops as illustrated in FIG. 7. Next, the sewing material, or the stitchery material is directed through a lock stitch that is located on the left side of the overlying set of loops, thereby forming a petal of the flower shape. The next petal is formed by overlapping the next set of loops to the left of the next adjacent set of loops with the next adjacent set of loops. The stitchery material is directed from the lock stitch and between the sets of loops to form another french knot or lock stitch fastening together the overlapping end regions of the loops. This procedure is continued until all the desired petals have been formed. It should be noted that many variations in the above stitchery method may be utilized and, in addition, contrasting materials and colors may also be incorporated. Any desired effect may be achieved by employing more or less loops than the number described herein and using materials and color combinations as desired.

Obviously, many modifications and variations of the present invention are possible in light of the above teachings. It is therefore to be understood that numerous modifications or alterations may be made therein without departing from the spirit and scope of the invention as set out in the appended claims.

It now should be apparent that the present invention provides a loom structure which may be employed in conjunction with stitchery methods for creating and forming stitchery ornaments having three-dimensional character and properties.

Although particular structures and methods have been discussed in connection with a specific loom embodiment or with a specific embodiment of a loom structure constructed in accordance with the teachings of the present invention, and various stitchery methods have been discussed in connection with such a loom structure, others may be utilized. Furthermore, it will be understood that although an exemplary embodiment of the present invention has been disclosed and discussed, other applications and stitchery ornaments are possible and that the embodiments disclosed may be subjected to various changes, modifications and substitutions without necessarily departing from the spirit of the invention.

What is claimed is:

1. A three-dimensional ornament comprising:

a plurality of sets of multiple loops of stitchery material circularly disposed in a substantially cylindrical shape, each of said plurality of sets having its center contained on the surface of said substantially cylindrical shape and each of said plurality of sets being contiguous to respective adjacent sets of multiple loops, a portion of each of said plurality of sets being sewn to a contiguous portion of each respective adjacent set, thereby successively securing said plurality of sets of multiple loops together to maintain said cylindrical shape, the ends of said plurality of sets of multiple loops adjacent one end of said cylindrical shape being linked with sewing material alternately passing through each set of multiple loops in succession, said sewing material being drawn up tight to link said ends of said plurality of sets of multiple loops to form a base for the ornament.

2. The article described in claim 1 wherein another portion of each of said plurality of sets of multiple loops of stitchery material is sewn to a contiguous portion of each respective adjacent set, thereby further successively securing said plurality of sets of multiple loops to maintain said cylindrical shape.

3. The article described in claim 2 further including stitchery material passing through the sewn contiguous portions joining adjacent sets of multiple loops and extending to the outermost end portions of a first set of said adjacent sets of elongated multiple loops, at least one set of elongated multiple loops being successively overlapped with said first set of elongated multiple loops to form a group of overlapping sets, said stitchery material passing around the outermost end portions of said group of overlapping sets to secure said group of overlapping sets together, said stitchery material passing through the sewn contiguous portion joining the next adjacent set of multiple loops to the last set of the group of successively overlapped sets of multiple loops and extending to the outermost end portions of the next adjacent set of multiple loops, the remaining sets of multiple loops being similarly overlapped and linked in like manner with said stitchery material to create a stitchery ornament having a multiplicity of groups of overlapping multiple loops.

* * * * *